United States Patent [19]

Parrott et al.

[11] Patent Number: 4,767,289

[45] Date of Patent: Aug. 30, 1988

[54] PERISTALTIC PUMP HEADER

[75] Inventors: Patti L. Parrott, Dexter; James B. Howell, Ann Arbor, both of Mich.

[73] Assignee: Minnesota Mining and Manufacturing Company, St. Paul, Minn.

[21] Appl. No.: 948,047

[22] Filed: Dec. 31, 1986

[51] Int. Cl.[4] ..... A61M 5/00; F04B 43/12

[52] U.S. Cl. ..... 417/477; 417/478; 604/4; 604/153; 137/493

[58] Field of Search ..... 417/295, 474–478; 604/4, 153; 137/493

[56] References Cited

U.S. PATENT DOCUMENTS

| | | | |
|---|---|---|---|
| 2,772,817 | 12/1956 | Jauch | 417/478 X |
| 3,127,846 | 4/1964 | Kerns | 604/153 X |
| 3,190,229 | 6/1965 | Turowski | 417/478 X |
| 3,218,979 | 11/1965 | Baldwin | 417/478 X |
| 4,250,872 | 2/1981 | Tamari | 128/1 D |
| 4,515,589 | 5/1985 | Austin et al. | 604/122 |
| 4,650,471 | 3/1987 | Tamari | 604/153 |

OTHER PUBLICATIONS

Osborn, John J., M.D., et al., "Hemolysis During Perfusion", *Journal of Thoracic and Cardiovas. Surg.*, vol. 43, No. 4, Apr., 1962, pp. 459–464.

Advertisement: American Omni Medical, Inc., 2930–G Grace Lane, Costa Mesa, Calif., "Suction Control Valve (Nonadjustable)", Cat. No. RLV-2100.

Austin, Bates, et al., 37 Left Ventricular Assist Using a New Blood Pump Design", paper presented at St. Luke's Hospital, Phoenix, Ariz.

Austin, Vaughn, et al., "Cardiopulmonary Bypass Using a New Extracorporeal Pumping Device", article presented at St. Luke's Hospital Med. Ctr., Phoenix, Ariz.

Tamari, et al., "A New Pump Chamber for the Roller Pump Allows Control of Flow Output by Filling Pressure", vol. XXX, *Trans. Am. Soc. Artif. Intern. Organs*, 1984, pp. 561–566.

*Primary Examiner*—Carlton R. Croyle
*Assistant Examiner*—Theodore Olds
*Attorney, Agent, or Firm*—Donald M. Sell; Robert W. Hoke, II

[57] ABSTRACT

A pump header for use in a peristaltic pump. The pump header includes a flexible outer tube, a collapsible-expandable inner tube, a pressure control valve member and a one-way-flow valve member. The inner tube is disposed within a passageway of the outer tube. The pressure control valve member and the one-way-flow valve member are responsive to positively-pressured liquid at an inlet to the inner tube and allow the liquid to enter a passageway of the inner tube from which the fluid can be pumped by the action of the peristaltic pump. The positively pressured liquid can only pass from the one-way-flow valve member.

9 Claims, 3 Drawing Sheets

PERISTALTIC PUMP HEADER

FIELD OF THE INVENTION

This invention relates to pump headers and in one aspect to a pump header suitable for use with a peristaltic pump.

BACKGROUND ART

Peristaltic pumps are volumetric pumps which progressively compress a flexible tube to propel liquid along the tube under the influence of rotating members which contact the tube at spaced-apart locations. Such pumps are commonly used in cardiovascular surgery for circulating blood between a patient and a heart-lung machine. Other common uses for such pumps are the transfer of blood between a patient and a kidney dialyser and the intravenous infusion of medication.

Known advantages of peristaltic pumps include their simple construction and their containment of the pumped liquid in a simple, chemically-inert tube that can be easily sterilized. Disadvantages of known peristaltic pumps include their ability to pump gases, as well as liquids, when only the passage of liquids is desired. For example, when used in cardiovascular surgery for circulating blood between a patient and a heart-lung machine, a peristaltic pump can propel air, as well as blood that may be within the tubing, towards the patient. The risks of systemic and coronary air embolisms are well documented. U.S. Pat. No. 4,515,589 describes at column 7, starting at line 11, an inlet valve 100 designed to prevent the entrainment of air when a peristaltic pump is pumping blood into a patient.

Systems for circulating blood between a patient and a heart-lung machine generally consist of two blood circuits. A major circuit receives blood draining from the vena cavae into the right side of the heart and oxygenates and returns the blood to the patient's aorta for further transmission to the patient's vital organs and appendages. A smaller suction circuit sucks blood from the left side of the heart. This sucked blood is mainly coronary, Thebesian and bronchial return and can be rather substantial. The blood sucked from the left side of the heart is saved and returned to the major circuit for oxygenation and eventual return to the patient.

The smaller suction circuit is known to be particularly susceptible to hemolysis due, inter alia, to the forcible suction of the blood from the left side of the heart and the mixing of air with the blood. Hemolysis is the damage of red blood cells with consequent elevation of free plasma hemoglobin and the attendant threat to the kidneys. Additionally, the smaller suction circuit can actually damage the heart tissue by pulling this tissue into the sucker. It is known to minimize this damage by providing a separate valve in the suction circuit that can be opened at a predetermined negative pressure to draw additional air, rather than heart tissue, into the suction circuit. As previously noted, however, the mixing of air with the blood can cause hemolysis.

Efforts have also been made in the past to minimize the negative pressures generated by the pumping action of a peristaltic pump in the major circuit. One example is an intermediate, gravity-fed, reservoir system as described in said U.S. Pat. No. 4,515,589. There, venous return is drained into a reservoir in the major circuit. An outlet from the reservoir is connected to a peristaltic pump header. The peristaltic pump header is a double lumen device with an inner tube that opens and closes in response to a positive fluid pressure from the reservoir. As shown in FIG. 5 and FIG. 6 of the patent, it is contemplated that the inner tube will progressively collapse as the level in the reservoir drops, so that entrainment of air into the patient's system is minimized. To further avoid the entrainment of air, it is said that the inlet valve previously referred to can be added to the inlet to the pump header.

It is believed that a separate inlet valve can cause problems. For one thing, the inlet valve can be forgotten by the attending medical personnel; there is nothing to ensure that the inlet valve will be added by the attending medical personnel. For another, the separate inlet valve can contribute to hemolysis, since the blood must move between two separate components.

Even if the inlet valve were an integral portion of the pump header described in said U.S. Pat. No. 4,515,589, its employment could be ineffectual. More particularly, the direction of the pump can typically be reversed by an inadvertent flip of a switch. Further, there is nothing to prevent the backwards reception of the pump header within the pump. In either case, the inlet valve would be effectively placed on the outlet side of the pump, thereby negating its effectiveness.

SUMMARY OF THE INVENTION

The present invention provides an integral or unitary, one-way-flow, sterilizable, pump header suitable for use in a conventional peristaltic pump, such as a conventional peristaltic pump having a pump housing, an arcuate surface within the pump housing defining a stator, a driveshaft adapted to be motor driven and having a portion disposed within the housing, and a rotor disposed within the housing and connected to the driveshaft and having a roller adapted to follow the stator when the driveshaft is driven by the motor.

The pump header comprises a flexible outer tube, a collapsible-expandable inner tube, a pressure control valve member and a one-way-flow valve member. The outer tube has an inlet, an outlet and a passageway there between. The outer tube is dimensioned to be received between the roller and the stator of the peristaltic pump.

The inner tube is disposed within the passageway of the outer tube. The inner tube includes an inlet portion terminating at an inlet, an outlet portion terminating at an outlet, and a passageway between the inlet and the outlet. The inlet and outlet portions are normally closed in cross section and openable in response to a positive fluid pressure.

The pressure control valve member comprises a housing receiving or surrounding the inlet portion of the inner tube, an inlet portion connected to and in direct liquid communication with the inlet portion of the inner tube, and an outlet portion connecting the outer tube to the inner tube adjacent the inlet of the outer tube. Positively-pressured fluid entering the inlet portion enters the inlet of the inner tube and expands and opens the normally closed inlet portion of the inner tube.

The one-way-flow valve member comprises a housing receiving or surrounding the outlet portion of the inner tube with the outlet of the inner tube disposed within this housing, an inlet portion connecting the outer tube to the inner tube adjacent the outlet of the outer tube, and an outlet portion in liquid communication with the outlet of the inner tube. Positively-pressured fluid entering the outlet portion of the inner tube from the passageway of the inner tube expands and opens the normally closed outlet portion thereof and exits the outlet of the inner tube within the housing. Positively-pressured fluid within this housing can only pass from the outlet portion of the valve member, thereby restricting fluid flow to one direction through the pump header.

BRIEF DESCRIPTION OF THE DRAWING

The invention is illustrated in the accompanying drawing wherein like numbers refer to like parts.

DETAILED DESCRIPTION

Figure 1:
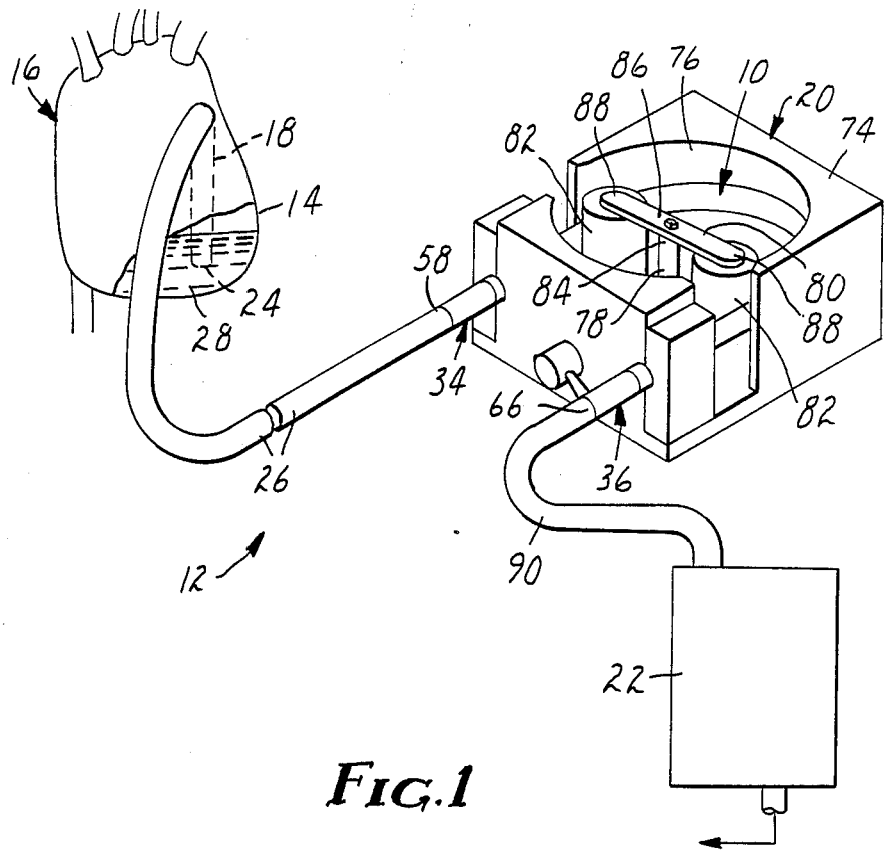
FIG. 1 is a schematic view of a preferred embodiment of the pump header of the present invention in a system suitable for venting the left ventricle of a heart during coronary artery bypass grafting.

Referring to the figures of the drawing, there is shown in FIG. 1 a schematic view of a preferred embodiment of the pump header 10 of the present invention in a system 12 suitable for venting the left ventricle 14 of a heart 16 during coronary artery bypass grafting. The system 12 is generally comprised of a vent 18, a peristaltic pump 20 and a cardiotomy reservoir 22. The vent 18 is placed in conventional fashion with its tip 24 generally disposed within the left ventricle 14 of the heart 16. Attached to the vent 18 opposite the tip 24 is a suitable, medical-grade tubing 26. A suitable vent 18 is a left ventricular vent catheter, Part Number 10610, available from Sarns/3M, Ann Arbor, Mich., U.S.A. Attached to the medical-grade tubing 26 opposite the vent 18 is the pump header 10. This establishes fluid communication between the left ventricle 14 and the pump header 10; blood 28 within the left ventricle 14 can pass into the tip 24 of the vent 18 and be delivered to the pump header 10 via the tubing 26.

The pump header 10 is shown in longitudinal sectional view in FIGS. 5A, 5B, 6 and 8 to comprise a flexible outer tube 30, a collapsible-expandible and preferably elastomeric inner tube 32, a pressure control valve member 34 and a one-way-flow valve member 36. As perhaps best shown in FIGS. 3 and 7, the outer tube 30 has an inlet 38, an outlet 40 and a passageway 42 there between. Similarly, the inner tube 32 has an inlet 44, an outlet 46 and a passageway 48 there between. The inner tube 32 is generally disposed within the passageway 42 of the outer tube 30. The inner tube 32 is preferably comprised of polyvinyl chloride having about 55 Durometer Shore A hardness and having a 0.38 mm wall thickness, available from Natvar Company, Clayton, NC., U.S.A. The inner tube 32 is preferably structurally capable of total and repeated collapse and expansion. The outer tube 30 is preferably comprised of polyvinyl chloride having 55–85 Durometer Shore A hardness and having a 1.77 mm wall thickness, available from Natvar Company, Clayton, NC., U.S.A. Most preferably, the outer tube 30 is about 70 Durometer Shore A polyvinyl chloride.

Figure 9:
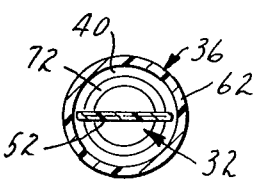
FIG. 9 is a cross-sectional view of the pump header of FIG. 1 taken approximately along the line 9—9 of FIG. 8.

Referring particularly now to FIGS. 5A, 5B, 6 and 8, the inner tube 32 includes a flattened inlet portion 50 terminating at the inlet 44 and a flattened outlet portion 52 terminating at the outlet 46. The inlet portion 50 extends outside the inlet 38 of the outer tube 30, and the portion 52 extends outside the outlet 40 of the outer tube 30. The flattened portions 50 and 52 of the inner tube 32 are normally closed in cross section and openable in response to a positive fluid pressure as perhaps best shown in FIG. 7 and FIG. 9 with respect to the flattened outlet portion 52. The normally closed state of the flattened portions 50 and 52 is greater ensured by the inclusion of a pair of generally parallel, creased and preferably sealed edge areas 54 laterally disposed on each of the flattened portions 50 and 52. These edge areas 54 are preferably formed by conventional radio frequency heating and melting techniques.

The pressure control valve member 34 preferably includes a rigid, 75–100 Durometer Shore A polyvinyl chloride housing 56, an inlet portion 58 and an outlet portion 60. The flattened inlet portion 50 of the inner tube 32 is received within or surrounded by the housing 56 with the inlet portion 58 connected to and in direct liquid communication with the flattened inlet portion 50 of the inner tube 32. The outlet portion 60 connects the outer tube 30 to the inner tube 32 adjacent the inlet 38 of the outer tube 30, so that positively-pressured blood 28 entering the inlet portion 58, as shown in FIG. 1, enters the inlet 44 of the inner tube 32 and expands and opens the flattened inlet portion 50. This, in turn, communicates the blood 28 with the passageway 48 of the inner tube 32 from which the blood 28 can be pumped by the peristaltic pump 20 in a manner to be explained.

The one-way-flow valve member 36 preferably includes a rigid, 75–100 Durometer Shore A polyvinyl chloride housing 62, an inlet portion 64 and an outlet portion 66. The flattened outlet portion 52 of the inner tube 32 is received within or surrounded by the housing 62 with the outlet 46 of the inner tube 32 freely disposed within the housing 62. The inlet portion 64 connects the outer tube 30 to the inner tube 32 adjacent the outlet 40 of the outer tube 30, so that positively-pressured fluid entering the flattened outlet portion 52 of the inner tube 32, from the passageway 48 of the inner tube 32 under the pressure of the peristaltic pump 20, expands and opens the flattened outlet portion 52 and exits the outlet 46 of the inner tube 32 within the housing 62. The outlet portion 66 is in liquid communication with the outlet 46 of the inner tube 32, so that positively-pressured fluid within the housing 62 can only pass from the outlet portion 66 of the one-way-flow valve member 36, thereby restricting fluid flow to one direction through the pump header 10.

Figure 2:
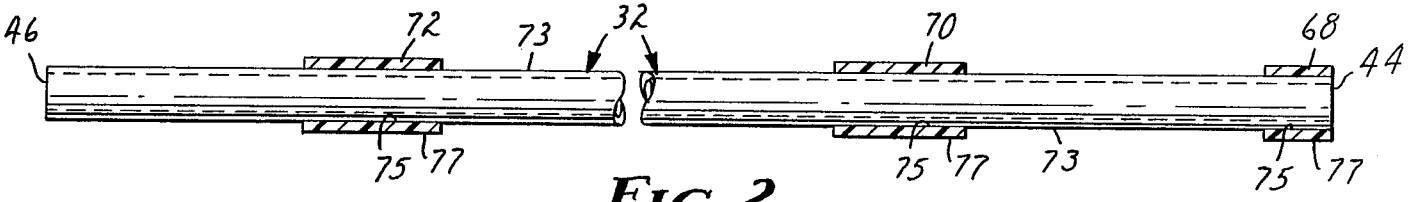
FIG. 2 is an enlarged, longitudinal sectional view of the pump header of FIG. 1 in a first stage of assembly.

An actual assemblying of the pump header 10 is shown in FIGS. 2, 3, 4, 5A and 5B. Referring first to FIG. 2, there is shown in enlarged, longitudinal sectional view, the pump header 10 of FIG. 1 in a first stage of assembly. Three spaced-apart, preferably ring-like, isolator spacers 68, 70 and 72 are affixed to an outer wall 73 of the inner tube 32. These spacers 68, 70 and 72 are preferably comprised of a resilient, medical-grade, 50–100 Durometer Shore A polyvinyl chloride tube, each having an inner wall 75 and an outer wall 77. The inner walls 75 are preferably continuously sealed to the outer wall 73 of the inner tube 32 over the entirety of the inner walls 75 using conventional bonding or radio-frequency sealing techniques. The first spacer 68 is sealed to the inner tube 32 adjacent the inlet 44 of the inner tube 32. The second spacer 70 is sealed to the inner tube 32 at a distance from the first spacer 68. The third spacer 72 is sealed to the inner tube 32 at a further distance from the first spacer 68.

Figure 3:
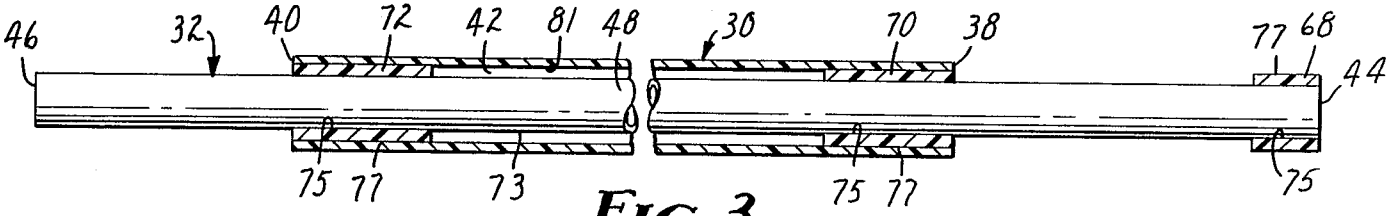
FIG. 3 is similar to FIG. 2 showing the pump header of FIG. 1 in a next stage of assembly.

Referring now to FIG. 3, the inner tube 32, including the second and third spacers 70 and 72, is shown disposed within the passageway 42 of the outer tube 30 with the second spacer 70 adjacent the inlet 38 of the outer tube 30 and the third spacer 72 adjacent the outlet 40 of the outer tube 30. These spacers 70 and 72 are affixed and preferably sealed to an inner wall 81 of the outer tube 30 over the entirety of the outer walls 77, in these respective positions, using conventional bonding or radio-frequency sealing techniques.

Figure 4:
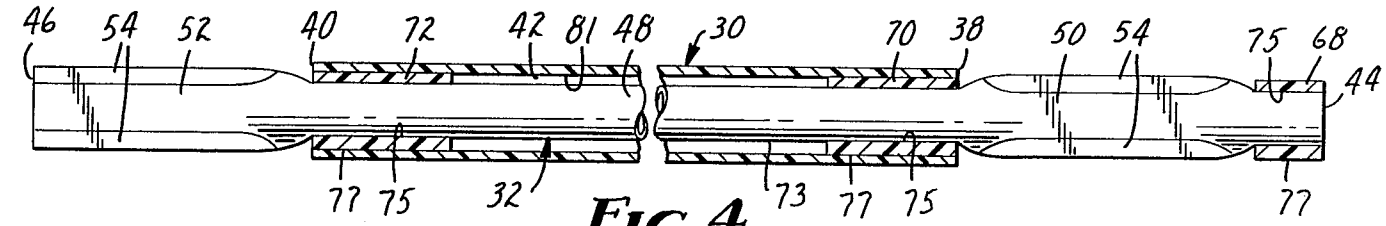
FIG. 4 is similar to FIG. 3 showing the pump header of FIG. 1 in a further stage of assembly.

Next, as shown in FIG. 4, the edge areas 54 of the inner tube 32 are preferably formed as previously described. This is preferably followed by the connection of the inlet portion 58 of the pressure control valve member 34 to the first spacer 68 generally opposite of the inner tube 32 as shown in FIG. 5B by conventional gluing or radio-frequency sealing techniques.

Figure 5A:
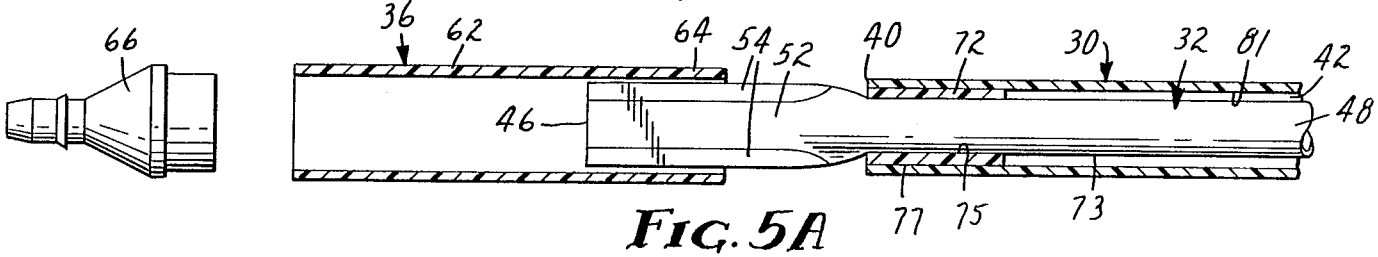
FIGS. 5A and 5B are similar to FIG. 4 showing the pump header of FIG. 1 in a yet further stage of assembly.
Figure 5B:
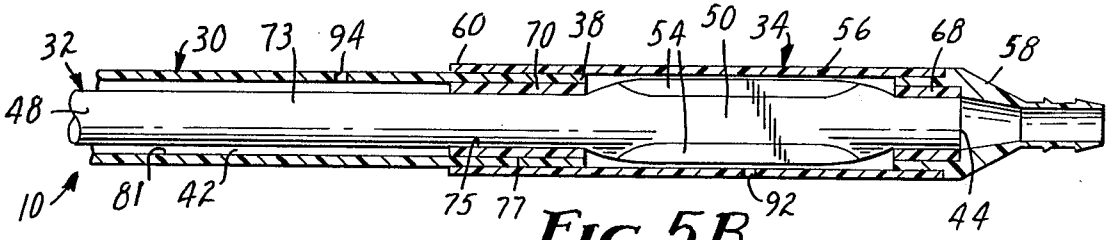
Figure 7:
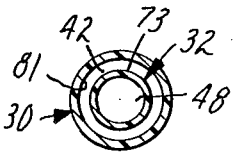
FIG. 7 is a cross-sectional view of the pump header of FIG. 1 taken approximately along the line 7—7 of FIG. 6.
Figure 6:
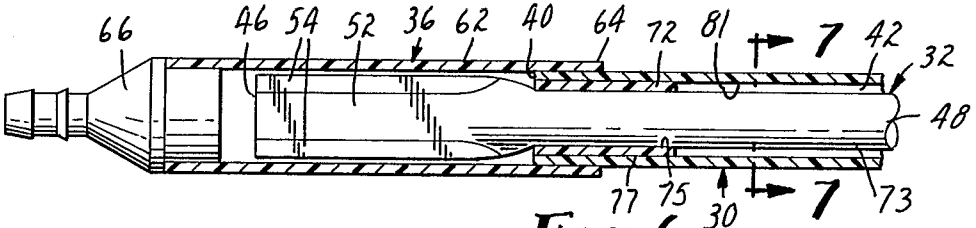
FIG. 6 is similar to FIG. 5 showing the pump header of FIG. 1 fully assembled and with portions broken away.
Figure 8:
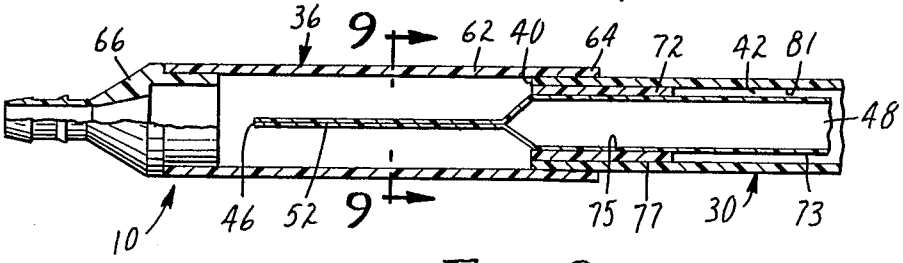
FIG. 8 is similar to FIG. 6 showing the pump header of FIG. 1 rotated 90 degrees with respect to a longitudinal axis through the center of the pump header with portions broken away.

Finally, as shown in FIGS. 5A and 5B, the housings 56 and 62 are positioned and affixed over the flattened portions 50 and 52, respectively, and the outlet portion 66 of the one-way-flow valve member 36 is connected to the housing 62. More particularly, one end of the housing 56 is sealingly connected to the inlet portion 58 generally opposite of the first spacer 68, and the other end of the housing 56 is sealingly connected to the outer tube 30 generally opposite of the second spacer 70. Similarly, one end of the housing 62 is sealingly connected to the outer tube 30 generally opposite of the third spacer 72, and the other end of the housing 62 is sealingly connected to the outlet portion 66. The fully assembled pump header 10 with portions broken away is shown in FIG. 6. FIG. 7 is similar to FIG. 6 showing the pump head 10 rotated 90 degrees with respect to a longitudinal axis through the center of the pump header 10.

During the actual assembly of the pump header 10, the distance between the first spacer 68 and the second spacer 70 is controlled relative to the length of the flattened inlet portion 50 so that this portion 50 is tensioned sufficiently to restrict and preferably prevent folding and to maintain this portion 50 in its normally closed in cross section state. This tension, in turn, fixes the opening and closing of this portion 50 in response to fluid pressure. Preferably, this portion 50 opens at a hydrostatic pressure head at the inlet 44 of the inner tube 32 in the range of 0.0 cm to +10.0 cm of water as measured by a conventional water-type manometer and most preferably at about +2.5 cm of water. Similarly, this portion preferably closes at a hydrostatic pressure head in the range of −10.0 cm to 0.0 cm of water and most preferably at about −2.5 cm of water. In other words, opening and closing preferably occurs between ±10.0 cm of water pressure and most preferably occur at ±2.5 cm of water pressure.

The foregoing description of the opening and closing of the flattened inlet portion 50 at predetermined pressures is relative to ambient atmospheric pressure. The presence of ambient atmospheric pressure within the housing 56 can be ensured by venting the housing 56 to the atmosphere. This can be simply accomplished by the addition of a through aperture 92 in the housing 56.

It will be appreciated that alternative techniques for achieving a pressure differential between the inside and the outside of the flattened inlet portion 50 can be utilized for effecting the opening the closing of this portion 50. More particularly, the luminar space within the pressure control valve member 34, between the housing 56 and the inner tube 32, can be raised above or reduced below atmospheric to retard or advance, respectively, the opening of this portion 50. The converse is true for the closing of this portion 50. For example, this luminar space can be partially evacuated, causing this portion 50 to open and close at relatively lower pressures.

The luminar space between the outer tube 30 and the inner tube 32 can be similarly pressure controlled or regulated. In the preferred embodiment, this luminar space is vented to the atmosphere by the addition of a through aperture 94 in the outer tube 30. Alternatively, the pressure within this luminar space may be raised or lowered or this luminar space may be filled with a liquid or another gas, other than air, to optimize the fluid flow through the inner tube 32.

Referring now to FIG. 1, the pump header 10 is shown received within the peristaltic pump 20. A suitable pump 20 is a 7400 pump available from Sarns/3M, Ann Arbor, Mich., U.S.A. The pump 20 has a pump housing 74, an arcuate surface 76 within the pump housing 74 defining a stator 76, a driveshaft 78 adapted to be motor driven, a rotor 80 disposed within the housing 74 and a pair of rollers 82. The driveshaft 78 has an end portion 84 disposed within the housing 74. The rotor 80 has an intermediate portion 86 connected to the end portion 84 of the driveshaft 78 and a pair of end portions 88, each of these end portions 88 terminating at one of the rollers 82. Each of the rollers 82 adapted to follow the stator 76 when the driveshaft 78 is driven by the motor, not shown. The outer tube 30 of the pump header 10 is dimensioned to be received between the rollers 82 and the stator 76 of the peristaltic pump 20.

The outlet portion 66 of the pump header 10 is attached to one end of a suitable, medical-grade tubing 90. The other end of the tubing 90 is attached to the cardiotomy reservoir 22, so that fluid communication between the pump header 10 and the cardiotomy reservoir 22 is established. A suitable reservoir 22 is a 2500 ml cardiotomy reservoir available from Sarns/3M, Ann Arbor, Mich., U.S.A.

From the cardiotomy reservoir 22, the blood 28 is returned to the patient in conventional fashion. Typically, this involves filtering the blood 28, oxygenating the blood 28, and pumping the blood 28 back into the patient.

The method by which the pump header 10 in the system 12 can be used to vent the heart 16 during coronary artery bypass grafting will next be described generally in relation to FIGS. 1, 6, 7 and 8. Referring specifically to FIG. 1, the heart 16 is shown in schematic view with portions broken away to expose the tip 24 of the vent 18 submerged within the blood 28. The heart 16 is generally elevated with respect to the pump 20, so that a portion of the blood 28 flows through the tubing 26, opens the flattened inlet portion 50 of the inner tube 32 of the pump header 10, and enters the passageway 48 of the inner tube 32. Upon activation of the pump 20, the rollers 82 are brought into contact with the outer tube 30 of the pump header 10 and progressively compress the inner tube 32 to force the blood 28 towards the cardiotomy reservoir 22.

If for any reason the positive fluid pressure of the blood 28 at the inlet portion 58 of the pump header 10 is lost, the flattened inlet portion 50 of the inner tube 32 will return to its normally closed in cross section state. In this state, the first and second spacers 68 and 70 structurally support this portion 50, mechanically isolating this portion 50 from pressure changes occuring in the inner tube 32 within the outer tube 30 as the roller 82 alternately engages and disengages the tubes 30 and 32. This, in turn, greater ensures the pressure control valve 34 only responds to pressure changes at the inlet 44 of the inner tube 32.

The closing of the flattened inlet portion 50 effectively stops the flow of fluid into the passageway 48 of the inner tube 32. This can be particularly advantageous when the loss of fluid pressure is due to lack of blood 28 within the heart 16. The closing of the flattened inlet portion 50 effectively isolates the heart 16 from the negative pressures generated by the pump 20 when no liquid is available to be pumped. Hence, negative pressures are avoided in the heart 16 without the entrainment of air within the blood 28.

If for any reason the pump header 10 is received within the pump 20 with the one-way-flow valve member 36, rather than the pressure control valve member 34, attached to the tubing 26, fluid will not pass through the pump header 10 as previously described. This one-way nature of the pump header 10 is caused by the structure of the one-way-flow valve member 36. As previously described, the flattened outlet portion 52 of the inner tube 32 is received within the housing 62 with the outlet 46 of the inner tube 32 freely disposed within the housing 62; i.e., the outlet 46 is not directly connected to the outlet portion 66. Any blood 28, air or other fluid entering the pump header 10 from the outlet portion 66 tends to further press closed, rather than open, the flattened outlet portion 52 of the inner tube 32. This one-way nature of the pump header 10 insures that the pump header 10 will not inadvertently be received within the peristaltic pump 10 with the direction of fluid flow such that fluid is actually pumped into, rather than away from, the left ventricle 14 of the heart 16.

From the foregoing, it will be apparent that various modifications and changes may be made by those skilled in the art without departing from the scope and spirit of the invention. Because these modifications and changes may be made by one skilled in the art and without departing from the scope and spirit of the invention, all matters shown and described are to be interpreted as illustrative and not in a limiting sense.

We claim:

1. An integral, one-way-flow, steriliable, pump header suitable for use in a peristaltic pump having a pump housing, an arcuate surface within said pump housing defining a stator, a driveshaft adapted to be motor driven and having a portion disposed within said housing, a rotor disposed within said housing and connected to said driveshaft and having a roller adapted to follow said stator when said driveshaft is driven by said motor, said pump header comprising:

A. a flexible outer tube having an inlet, an outlet and a passageway there between, said flexible outer tube being dimensioned to be received between said roller and said stator of said peristaltic pump;

B. a collapsible-expandable inner tube disposed within said passageway of said flexible outer tube, said inner tube including:

(1) a normally closed in cross section and openable in response to a positive fluid pressure, inlet portion extending outside said inlet of said flexible outer tube and terminating at an inlet;

(2) a normally closed in cross section and openable in response to a positive fluid pressure, outlet portion extending outside said outlet of said flexible outer tube and terminating at an outlet; and (3) a passageway between said inlet and said outlet of said inner tube;

C. a pressure control valve member including:

(1) a housing receiving said normally closed in cross section and openable in response to a positive fluid pressure, inlet portion of said inner tube;

(2) an inlet portion connected to and in direct liquid communication with said inlet portion of said inner tube, so that positively-pressured fluid entering said inlet portion of said valve member enters said inlet of said inner tube and expands and opens said normally closed inlet portion of said inner tube; and (3) an outlet portion connecting said flexible outer tube to said inner tube adjacent said inlet of said flexible outer tube;

D. a one-way flow valve member including:

(1) a housing receiving said outlet portion of said inner tube with said outlet of said inner tube disposed within said housing, so that positively-pressured fluid entering said outlet portion of said inner tube from said passageway of said inner tube expands and opens said normally closed outlet portion of said inner tube and exits said outlet of said inner tube within said housing;

(2) an inlet portion connecting said flexible outer tube to said inner tube adjacent said outlet of said flexible outer tube; and (3) an outlet portion in liquid communication with said outlet of said inner tube, so that positively-pressured fluid within said housing can only pass from said outlet portion of said one-way flow valve member, thereby restricting fluid flow to one direction through said pump header;

E. a first resilient spacer having an inner wall affixed to said inner tube adjacent said inlet of said inner tube and an outer wall affixed to said inlet portion of said pressure control valve member; and F. a second resilient spacer having an inner wall affixed to said inner tube and an outer wall affixed to said outer tube adjacent said inlet of said outer tube, so that said inlet portion of said inner tube is substantially isolated from the remainder of said inner tube, thereby greater ensuring that said pressure control valve member only responds to pressure changes at said inlet of said inner tube.

2. The pump header according to claim 1 further comprising means for achieving a pressure differential between the outside and the inside of said inlet portion of said inner tube that is received within said housing so that said pressure differential can be utilized for effecting the opening and closing of said inlet portion of said inner tube.

3. The pump header according to claim 2 further comprising means for achieving a pressure differential between the outside and the inside of said inner tube that is disposed inside said outer tube, said pressure differential being separate from said pressure differential within said housing of said pressure control valve member, so that said pressure differential within said outer tube can be varied independently of said pressure differential within said housing.

4. The pump heater according to claim 1 further comprising a third resilient spacer having an inner wall affixed to said inner tube and an outer wall affixed to said outer tube adjacent said outlet of said outer tube.

5. The pump header according to claim 4 wherein said first, second and third spacers are comprised of a polyvinyl chloride tube having a hardness in the range of 55–85 Durometer Shore A.

6. The pump header according to claim 1 wherein said inner tube is comprised of polyvinyl chloride having a hardness of about 55 Durometer Shore A.

7. The pump header according to claim 6 wherein said outer tube is comprised of polyvinyl chloride having a hardness in the range of 55–85 Durometer Shore A.

8. The pump header according to claim 1 further comprising a pair of generally parallel, creased edge areas laterally disposed on said inlet portion of the inner tube.

9. The pump header according to claim 8 further comprising a pair of generally parallel, creased edge areas laterally disposed on said outlet portion of the inner tube.

* * * * *